US006013881A

United States Patent [19]

Hall et al.

[11] Patent Number: 6,013,881

[45] Date of Patent: Jan. 11, 2000

[54] KEY OPERATED SAFETY INTERLOCK SWITCH

[75] Inventors: Jeffrey Scott Hall, Winnebago; Mark Andrew Mantua; David Elmer Olsen, both of Freeport, all of Ill.

[73] Assignee: Honeywell Inc., Minneapolis, Minn.

[21] Appl. No.: 09/281,534

[22] Filed: Mar. 30, 1999

[51] Int. Cl.[7] ..... H01H 27/00

[52] U.S. Cl. ..... 200/43.04; 200/17 R; 200/43.07; 200/61.62

[58] Field of Search ..... 200/17 R, 43.01, 200/43.04–43.09, 50 R, 50 A, 61.62–61.68, 334

[56] References Cited

U.S. PATENT DOCUMENTS

| | | | |
|---|---|---|---|
| 4,524,251 | 6/1985 | Schulz | 200/42 R |
| 4,658,102 | 4/1987 | Seim et al. | 200/17 R |
| 4,963,706 | 10/1990 | Mohtasham | 200/334 |
| 5,464,954 | 11/1995 | Kimura et al. | 200/61.62 |
| 5,473,127 | 12/1995 | Falcon et al. | 200/43.04 |
| 5,516,993 | 5/1996 | Wecke et al. | 200/17 R |
| 5,703,339 | 12/1997 | Rapp et al. | 200/17 R |

OTHER PUBLICATIONS

Honeywell, "GK Solenoid Key Operated Safety Interlock Switch", Product Sheet, Dec. 1997, Honeywell Micro Switch. Freeport. Illinois. 61032. USA.

*Primary Examiner*—Michael Friedhofer
*Attorney, Agent, or Firm*—Kris T. Fredrick

[57] ABSTRACT

An operating head assembly for a key operated safety switch contains within its housing two inwardly biased locking plates surrounding and locking an operating cam. A key with beveled faces forces the locking plates outward, freeing the cam to rotate. A cross bar on the key rotates the cam to the operating position. The safety switch is thus not easily defeated by simple devices.

19 Claims, 6 Drawing Sheets

KEY OPERATED SAFETY INTERLOCK SWITCH

BACKGROUND OF THE INVENTION

1. Field of the Invention

The present invention relates generally to key operated safety switches. More specifically, the present invention relates to key operated operating heads which are fastened to switch mechanisms to prevent the undesired flow of electricity to dangerous apparatus.

2. Description of the Related Art

The need for safety type switches is increasing throughout the world, particularly in the machine tool industry. Typically, in years past, traditional, simple, limit switches, such as Honeywell model no. LSAlA, were used to sense the position of guards or doors on machining centers. However, machine operators have found simple means of disabling these switches, effectively bypassing them, which allowed the operators easier access to the work area or an increase in their rate of part production. But, the safety features were then neutralized.

International standards have been written to keep the use of traditional limit switches to a minimum, and require Safety Interlock Switching, similar to Honeywell's GK, GKL and GKR series of Key Operated Sensors. Reference may be had to U.S. Pat. No. 5,473,127, to Falcon, et al., of common ownership herewith. There are testing agencies throughout the world which perform tests and authorize Third Party Approval for such products. One of them is BIA, based in Cologne, Germany, that mandates the specifications and requirements for these types of devices. Their specification (GS-ET-19), which covers solenoid locking/unlocking Interlock switches, is very similar to IEC 947-5-1, but with added requirements regarding the bypassing, or defeating, of an Interlock Switch by means of a tool other that the one intended for use. This paragraph, Paragraph 3.23, Protection Against Easy Bypassing is defined to prevent "easy bypassing means operating the lock mechanically by hand or with a simple device such as a tool, pencil, pin, screw, nail, etc. . . . Devices deemed not to be simple are those made using tools in more than one stage".

Thus there is a desire for key operated safety switches which meet this requirement of not being easily defeated by simple tools. Such a device is also desirably made of fewer and more cost effective parts to lessen the economic burden on the purchaser.

SUMMARY OF THE INVENTION

An operating head has a housing containing locking, camming, and plunger parts. Two inwardly biased side locks surround a cam and are keyed to the housing to prevent their rotation and have upper back and lower front lock blocks preventing rotation of the cam between them when not spread by a key. The cam operates an activation plunger for a safety switch preventing electrical flow when in the locked, or key removed, position. The key is a four-tined key with each tine being separated by a cam-surrounding central channel and shaft-surrounding side channels. Each tine has a beveled face on each forward side face for contacting the locking members. The key is inserted forcing the locking members to spread apart thereby removing the lock blocks from contact with the cam. Further insertion of the key causes a crossbar between the upper two tines of the key to engage a cam face which rotates the cam to place the activation plunger in a position unlocking the safety switch and allowing electrical flow.

FIG. 1 shows an exploded view of an operating head assembly according to the present invention. A cam is surrounded by locks. The cam and locks are located axially on a shaft. The locks are spring loaded from their outsides by springs. In the locked position, the cam is prevented from being rotated due to locking features of both locks. The locks are also keyed, or abut to, the housing, preventing rotation of the whole cam/lock mechanism in the locked position and preventing rotation of the locks in any case. When an actuating key is inserted, it first must spread the locks horizontally apart from the cam. When separation is complete, the locks do not contact the cam and it is free to rotate. A cross member on the key then contacts the cam to rotate it, which in turn releases a plunger. This plunger releases/actuates a contact block, or switch, within a safety interlock housing, and allows the flow of electricity. This invention is adapted for alternate key-entry positions; side and top. The above sequence of operation applies to both entries.

FIG. 2 shows a view in the locked position with the cover off, the operating key out, and the position of the cam "A" prevented from being rotated by two locks. The plunger is in the down position and the positively driven normally closed (N.C.) contact(s) of the contact block/switch would be open which puts the Safety Interlock Switch in a "safe" condition.

FIG. 3 shows a view, in the unlocked position, with the cover off, the operating key fully inserted, and the position of the two locks being spread horizontally by key insertion, and cam rotated backward to allow the plunger to retract to the up position. Further, the contact block/switch would be in the released position and the N.C. contact(s) would be closed, which puts the Safety Interlock Switch in a "machine run" condition.

The present invention provides a product that has significant features including;

a) a mechanism that prevents bypassing with a simple tool;

b) provision for side or top key entry; and c) utilization of fewer and more cost-effective parts than previous designs.

BRIEF DESCRIPTION OF THE DRAWINGS

The present invention will be more fully and completely understood from a reading of the Description of the Preferred Embodiment in conjunction with the drawings, in which.

DESCRIPTION OF THE PREFERRED EMBODIMENT

Figure 1:
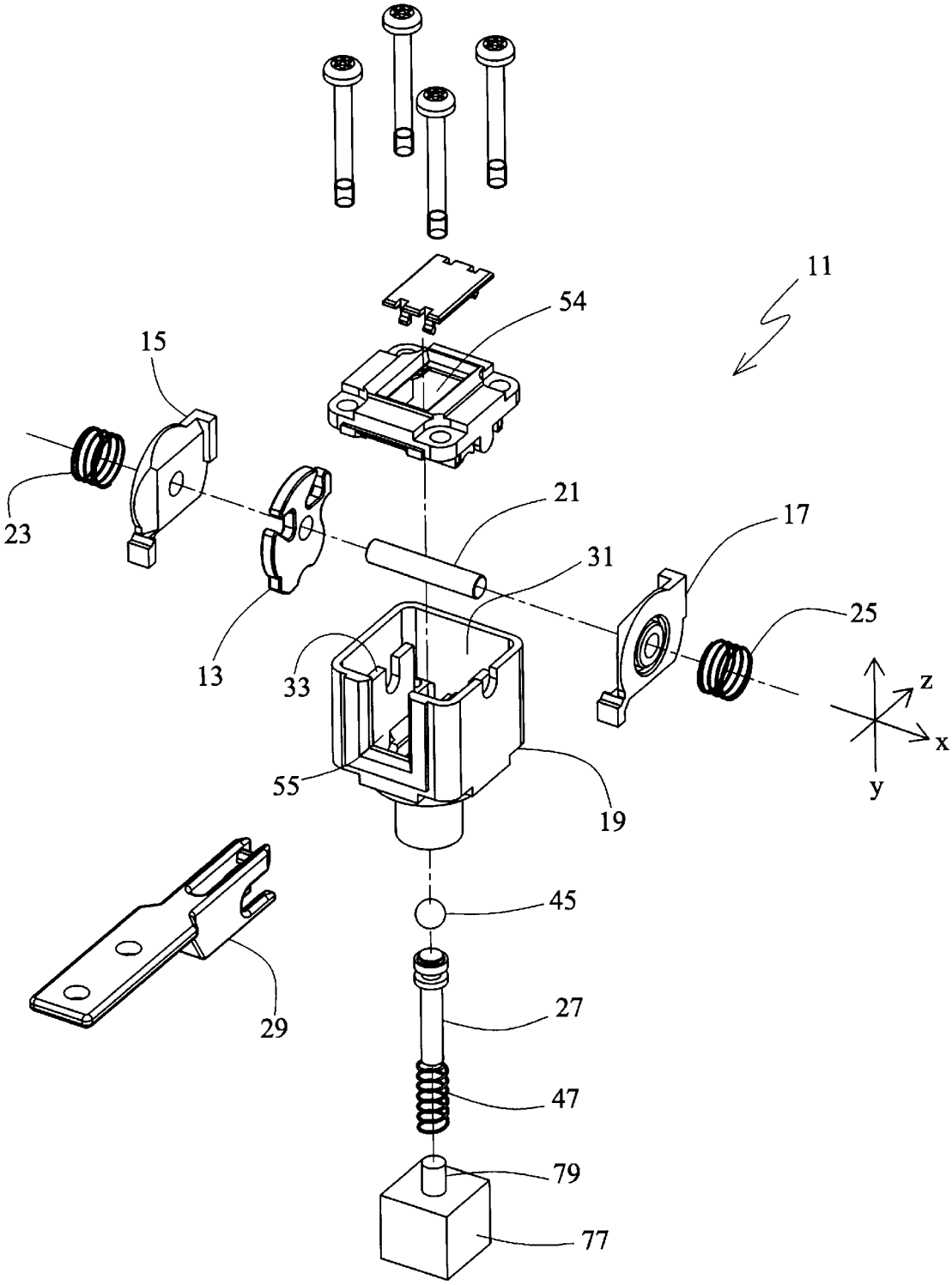
FIG. 1 is an exploded perspective view of an operating head assembly and its contact block according to the present invention

Throughout the Description of the Preferred Embodiment, like components will be identified by like reference numerals.

Figure 2:
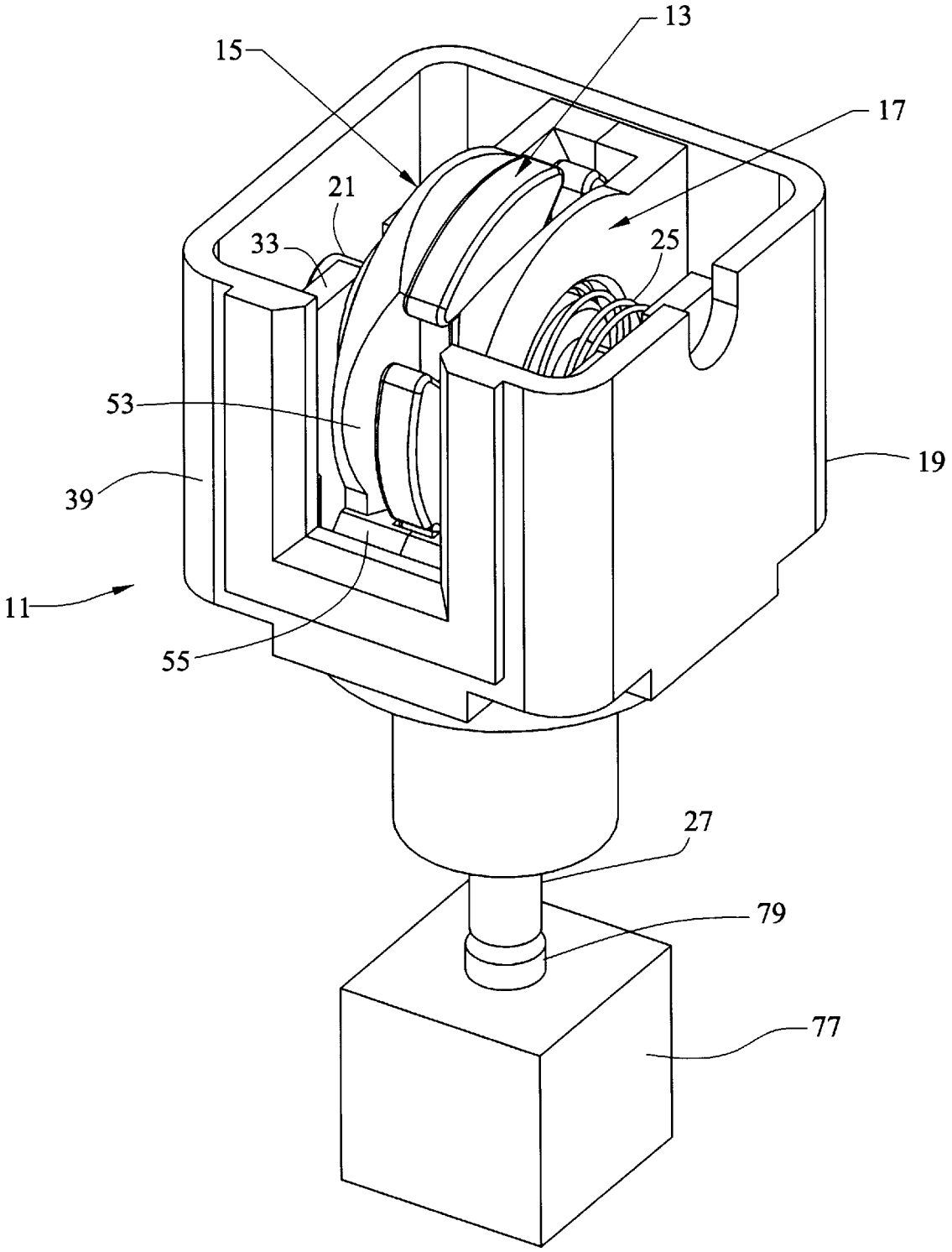
FIG. 2 is a perspective view of the operating head with the cover off and in the locked position
Figure 3:
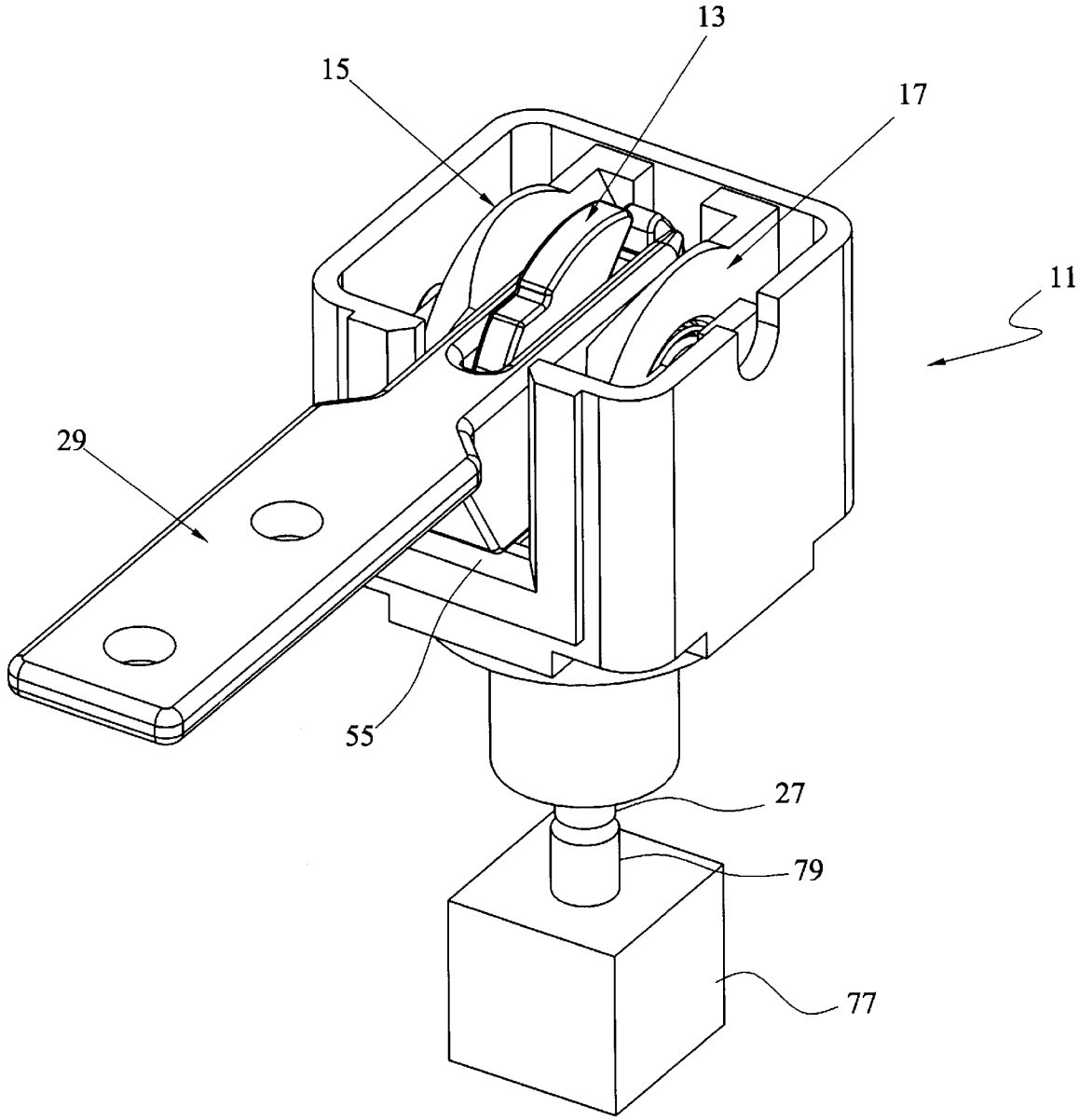
FIG. 3 is a perspective view of the operating head with the cover off and in the unlocked position with the key fully inserted
Figure 4:
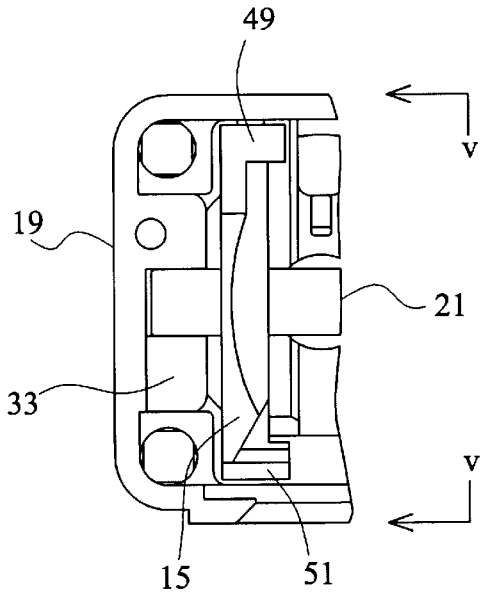
FIG. 4 is a top partial view of the left side locking member placed within the housing

As seen in FIGS. 1–3, an operating head 11 for a key operated safety switch comprises a cam 13, left and right locking members 15, 17, respectively, a housing 19, a shaft 21 left and right locking member biasing means 23 and 25 respectively, a plunger 27 and an accompanying key 29. The housing 19 as seen in FIG. 1 and in perspective and partial top view in FIG. 4 (without cam 13) defines a central cavity 31 containing an axle bearing 33. Because the left and right sides of the housing are generally mirror images along the X axis, only one half of the preferred embodiment will be described throughout this description, unless otherwise indicated.

Figure 5:
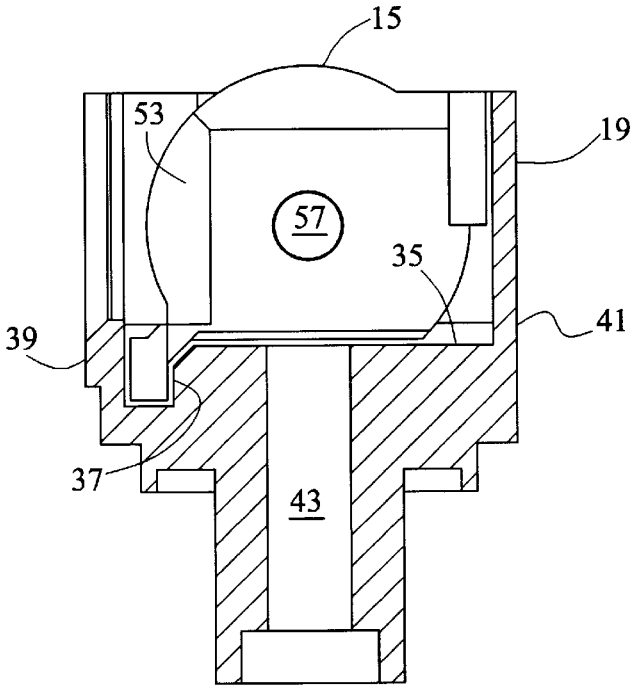
FIG. 5 is a cross section of the housing and locking member along lines V—V of FIG. 4.

As seen in the cross sectional view of FIG. 5, the housing 19 further contains surfaces or bosses 35, 37 for the nonrotatable support of the locking member 15. Frontwall 39, and backwall 41 further provide bearing surfaces for locking member 15 in order that the locking member be nonrotatably supported. Tolerances in the drawing figures may be exaggerated for clarity of illustration. The housing further has a plunger cavity 43 extending in the Y axis for allowing up and down movement of the plunger in response to the activation thereof by the cam 13. As seen in FIG. 1, a ball bearing 45 may preferably, but not necessarily, be used to interface between the cam 13 and the plunger 27. The plunger 27 is preferably but not necessarily biased against the cam 13 by a spring or other biasing means by a spring 47 or other suitable biasing means.

Figure 7:
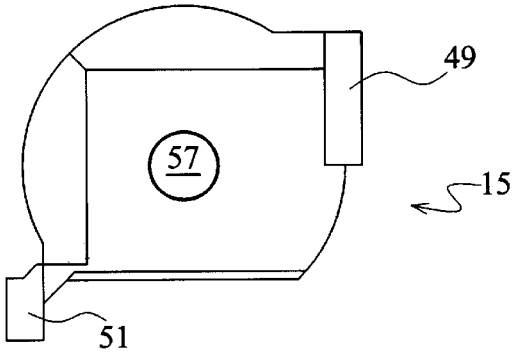
FIG. 7 is a detail side view of a locking member.
Figure 6:
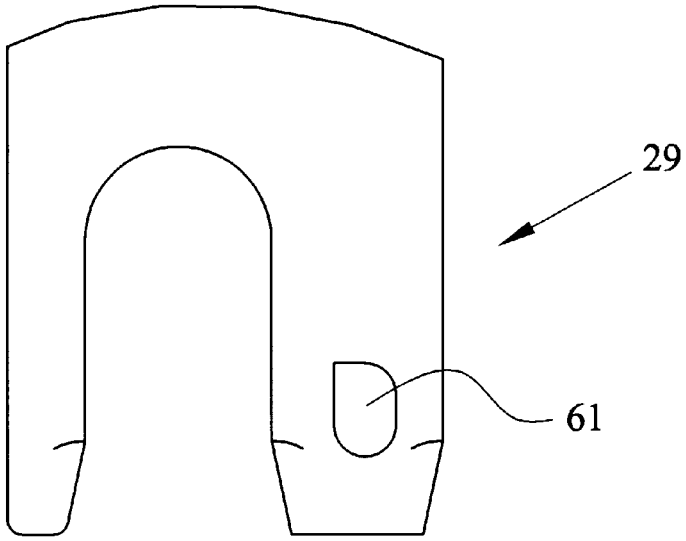
FIG. 6 is a detail side view of the cam, locking member and key.
Figure 6:
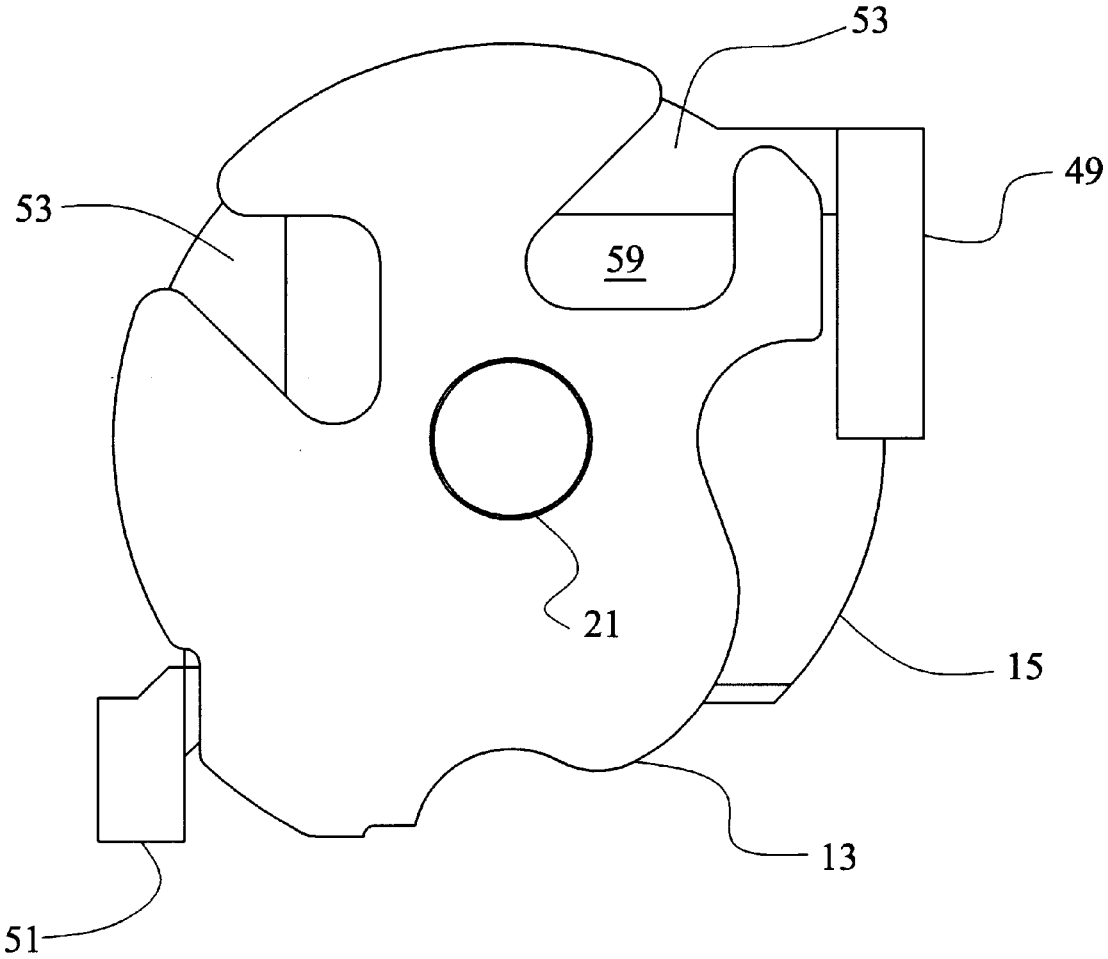

Referencing FIGS. 2,6, and 7, the left locking member 15 abuts cam 13 in the locked position, the locking member being biased towards the center position and cam 13 by biasing spring 23. Left and right locking members 15, 17 respectively, are biased to abut together and surround cam 13 when in the locked, or key removed, position.

Figure 9:
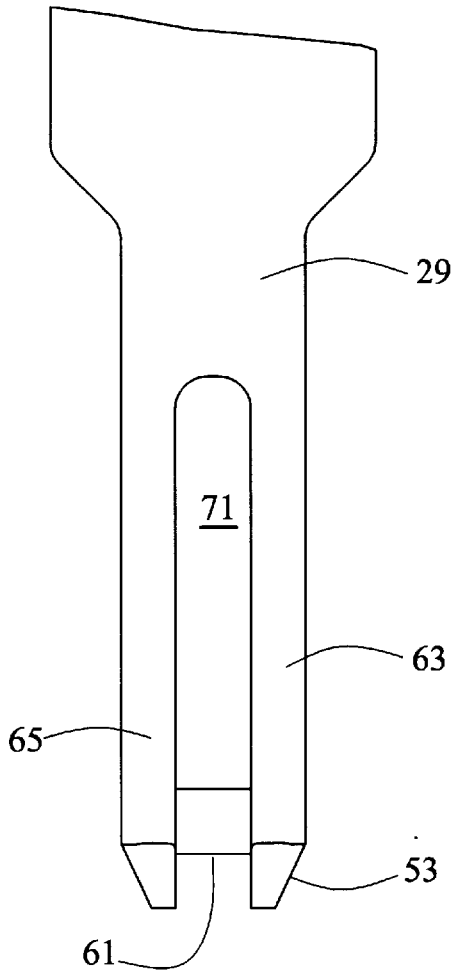
FIG. 9 is a top view of the front portion of the key.
Figure 8:
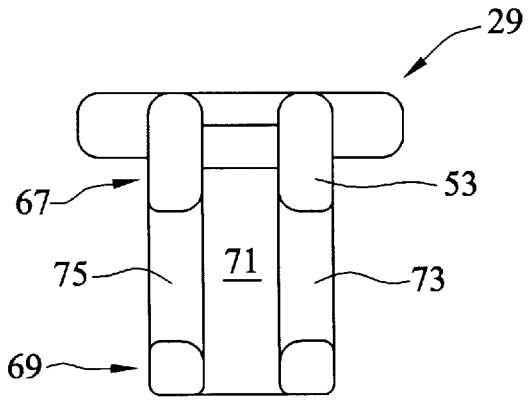
FIG. 8 is a front view of the key.

Referencing FIGS. 6 and 7, the locking member 15 has a back side top lock block 49 and a front side bottom lock block 51 which abut the cam 13 in the locked position to prevent its rotation about shaft 21. Locking member 15 has a radiused or beveled face 53 presented to the keyhole opening 55 in housing 19. The beveled face 53 permits acceptance of the beveled front end of key 29 as seen in FIGS. 6, 8 and 9. There is also a top beveled surface on the locking member for top-side key entry because the mechanism does not change positions from that shown. The key porthole is merely uncovered at the top of the operating head. The locking members of the preferred embodiment are further provided with an opening 57 for slidable mounting in the X axis on shaft 21.

The cam as seen in FIG. 6, is fitted with a key crossbar-accepting cutout 59 and suitable plunger actuation surfaces. Referencing FIGS. 3, 6, 8, and 9, when the key 29 is inserted through keyhole 55, it will spread locking members 15 and 17 laterally away from the cam along the X axis, thereby removing lock blocks 49, 51 from contact with the cam 13, allowing cam 13 to rotate. Rotation is caused by a crossbar member 61 which spans the top two tines 63, 65 of the key 29. The key 29 is equipped with four tines arranged in upper and lower pairs 67, 69 respectively with the right and left sides spaced apart by a central channel 71 which permits the cam 13 to enter therein. Upper and lower tined pairs 67, 69 are further separated by side channels 73, 75 which allow key travel over, or around, the shaft 21. It will be appreciated that full insertion of both pairs of tines 67, 69 are necessary to fully release locking member lock blocks which are positioned at the upper back and lower front of the locking means. Cross member 61 then engages the cam crossbar cutout 59 to rotate the cam to the unlocked position whereby plunger 27 is released; allowing contact block actuator 79 of contact block 77 to be released; thereby allowing the normally closed contacts thereof to allow electricity to flow to the device representing the hazardous situation.

By following the teachings of the present invention, the ordinary Artisan will realize that a safety switch operating head may be inexpensively constructed of minimal parts while making the lock mechanism hard to defeat with simple devices. It will further be appreciated that the preferred embodiment of the present invention as shown will allow the operating head to easily accept alternative placement of the key from either the top or front of the operating head without rearrangement of locking or cam parts.

While the present invention has been shown and described with reference to preferred embodiments, many alternatives will become apparent to the ordinarily skilled artisan upon disclosure of the present invention. Therefore the present invention is only to be limited by the claims appended hereto.

Having thus described the invention what is claimed is:

1. An operating head for a key operated safety switch comprising:

a) a cam and a plurality of locking members, the locking members having opposing lock blocks for contacting said cam to prevent rotation thereof;

b) a housing with a keyhole and having a central cavity containing an axle bearing and bosses for nonrotabably supporting the locking members;

c) a shaft fitted in the axle bearing for mounting the locking members and for rotatably mounting the cam;

d) the cam and locking members mounted on the shaft, the cam surrounded and captivated by the locking members in a cam captivating position;

e) biasing means for biasing the locking members to the cam captivating position;

f) a plunger contacting the cam for movement between 1st and 2nd plunger positions;

g) a key having four faces constructed and arranged to displace the locking members along the shaft to a cam noncaptivating position, and;

h) the key further having a cross bar surface for engaging the cam and having a void allowing the key to surround the cam when the key is fully inserted into the operating head.

2. The operating head of claim 1 wherein:

the locking members have front lock blocks adjacent a front wall of the housing.

3. The operating head of claim 1 wherein:

the locking members have back lock blocks adjacent a back wall of the housing.

4. The operating head of claim 1 wherein:

the key has four tines, each tine being separated by a cam surrounding central channel and shaft surrounding side channels.

5. The operating head of claim 4 wherein:

the tines have beveled faces for contacting the locking members.

6. The operating head of claim 1 wherein:

the locking members have beveled faces arranged to contact the key upon initial entry of the key.

7. The operating head of claim 1 further comprising:

a key having faces constructed and arranged to force the locking members to a cam noncaptivating position, the key further having a surface for engaging the cam and having a void allowing the key to surround the cam when the key is fully inserted into the operating head.

8. An operating head for a key operated safety switch comprising:

a) a cam and a plurality of locking members;

b) a housing with a keyhole and having a cavity for nonrotatably supporting the locking members;

c) a shaft for rotatably mounting the cam;

d) the cam surrounded and captivated by the locking members in a cam captivating position, the locking members having opposing lock blocks for contacting cam surfaces to prevent rotation thereof in the cam captivating position;

e) biasing means for biasing the locking members to the cam captivating position; and f) a plunger contacting the cam for movement between first and second plunger positions.

9. The operating head of claim 8 wherein:

the locking members have front lock blocks adjacent a front wall of the housing.

10. The operating head of claim 8 wherein:

the locking members have back lock blocks adjacent a back wall of the housing.

11. The operating head of claim 8 wherein:

the key has four tines, each tine being separated by a cam surrounding central channel and shaft surrounding side channels.

12. The operating head of claim 11 wherein:

the tines have beveled faces for contacting the locking members.

13. The operating head of claim 8 wherein:

the locking members have beveled faces arranged to contact the key upon initial entry of the key.

14. An operating head for a key operated safety switch comprising:

a) a cam and a plurality of locking members;

b) a housing with a keyhole and having a central cavity containing an axle bearing and bosses for nonrotatably supporting the locking members;

c) a shaft fitted in the axle bearing for mounting the locking members and for rotatably mounting the cam;

d) the cam and locking members mounted on the shaft, the cam surrounded and captivated by the locking members in a cam captivating position, the locking members have opposing lock blocks for contacting cam surfaces to prevent rotation thereof in the cam captivating position;

e) biasing means for biasing the locking members towards each other along the shaft to the cam captivating position;

f) a plunger contacting the cam for movement generally perpendicular to the shaft between first and second plunger positions; and g) a key insertable into the operating head having faces constructed and arranged to force the locking members to spread along the shaft to a cam noncaptivating position and a surface for engaging the cam.

15. The operating head of claim 14 wherein:

the locking members have front lock blocks adjacent a front wall of the housing.

16. The operating head of claim 14 wherein:

the locking members have front lock blocks adjacent a back wall of the housing.

17. The operating head of claim 14 wherein:

the key has four tines, each tine being separated by a cam surrounding central channel and shaft surrounding side channels.

18. The operating head of claim 17 wherein:

the tines have beveled faces for contacting the locking members.

19. The operating head of claim 14 wherein the locking members have beveled faces arranged to contact the key upon initial entry of the key.

* * * * *